United States Patent [19]

Savage

[11] Patent Number: 4,638,862

[45] Date of Patent: Jan. 27, 1987

[54] MEANS AND METHOD FOR PRODUCING HYDROCARBONS FROM AN EARTH FORMATION DURING THE RF RETORTING OF A HYDROCARBON STRATUM

[75] Inventor: Kerry D. Savage, Houston, Tex.

[73] Assignee: Texaco Inc., White Plains, N.Y.

[21] Appl. No.: 786,393

[22] Filed: Oct. 10, 1985

[51] Int. Cl.[4] ..... E21B 43/00

[52] U.S. Cl. ..... 166/248; 166/60

[58] Field of Search ..... 166/248, 60; 219/277, 219/270

[56] References Cited

U.S. PATENT DOCUMENTS

| | | | |
|---|---|---|---|
| 4,301,865 | 11/1981 | Kasevich et al. | 166/248 |
| 4,524,826 | 6/1985 | Savage | 166/248 |
| 4,553,592 | 11/1985 | Looney et al. | 166/248 |

*Primary Examiner*—Stephen J. Novosad
*Assistant Examiner*—Bruce M. Kisliuk
*Attorney, Agent, or Firm*—Robert A. Kulason; James J. O'Loughlin; Ronald G. Gillespie

[57] ABSTRACT

A method for obtaining a hydrocarbon liquid from a hydrocarbon strata of an earth formation traversed by a borehole wherein the hydrocarbon strata is subjected to RF electromagnetic energy retorting by locating metal tubing formed in a predetermined manner in that portion of the borehole traversing the hydrocarbon strata. Additional metal tubing formed in a conventional manner is connected with the metal tubing located in the borehole traversing hydrocarbon strata so that together they form a production stream. The hydrocarbon liquid from the borehole may be pumped through the production stream to the surface of the earth formation.

7 Claims, 3 Drawing Figures

MEANS AND METHOD FOR PRODUCING HYDROCARBONS FROM AN EARTH FORMATION DURING THE RF RETORTING OF A HYDROCARBON STRATUM

BACKGROUND OF THE INVENTION

Field of the Invention

The present invention relates to producing hydrocarbons from an earth formation and, more particularly, to producing hydrocarbons from an earth formation using RF retorting techniques.

SUMMARY OF THE INVENTION

A method for obtaining a hydrocarbon liquid from a hydrocarbon strata of an earth formation traversed by a borehole wherein the hydrocarbon strata is subjected to RF electromagnetic energy retorting, by locating metal tubing formed in a predetermined manner in that portion of the borehole traversing the hydrocarbon strata. Additional metal tubing formed in a conventional manner is connected with the metal tubing located in the borehole traversing hydrocarbon stata so that together they form a production stream. The hydrocarbon liquid from the borehole may be pumped through the production stream to the surface of the earth formation.

The objects and advantages of the invention will appear more fully hereinafter from a consideration of the detailed description which follows, taken together with the accompanying drawings wherein some embodiments of the invention are illustrated by way of example. It is to be expressly understood, however, that the drawings are for illustration purpose only and are not to be construed as defining the limits of the invention.

DESCRIPTION OF THE INVENTION

One of the problems encountered with in-situ radiant RF heating of earth materials such as oil shale, is related to the need for the ordinarily used metal tubular goods in producing wells. Yet, these electrically conducting tubulars act as "antennas" in the volumes which are to be heated by RF energy absorption. Normal oil field tubing in the presence of RF fields will have high induced current which in turn re-radiate RF fields. The re-radiated fields will be in the directions which tend to cancel and thus distort the original RF fields.

Figure 1:
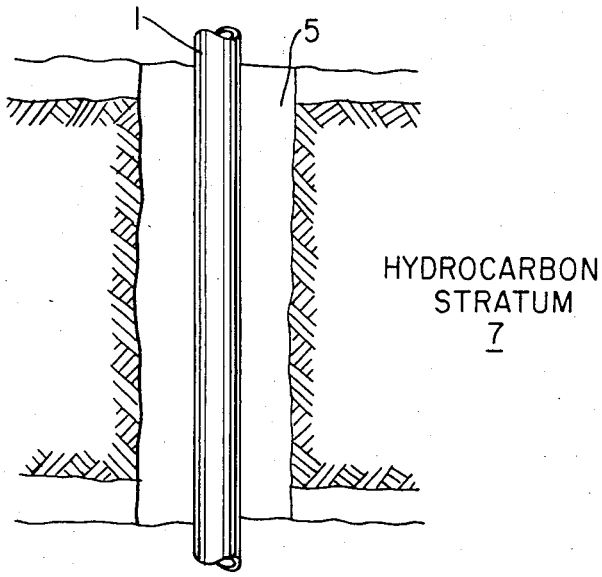
FIG. 1 PRIOR ART
FIG. 1 illustrates the prior art wherein the conventional production type tubing is shown in the production of an oil shale formation.

With respect to FIG. 1, the conventional approach to solving this problem has been to use ceramic tubing 1 in at least that portion of a borehole 5 of a producing well traversing a hydrocarbon stratum 7. However some problems have arisen in the use of ceramics. Ceramic tubing is very expensive and is awkward to use because of its weight, brittleness and thermal sensitivity (thermal shock problems). If ceramic tubing should break in use and fragments are deposited in the borehole 5, a major problem exists in either fishing for these fragments or in trying to drill them out. Further, in case of accidental "blowout" of the well the ceramic tubing fragmentizes and the fragments become very hazardous projectiles.

Figure 2:
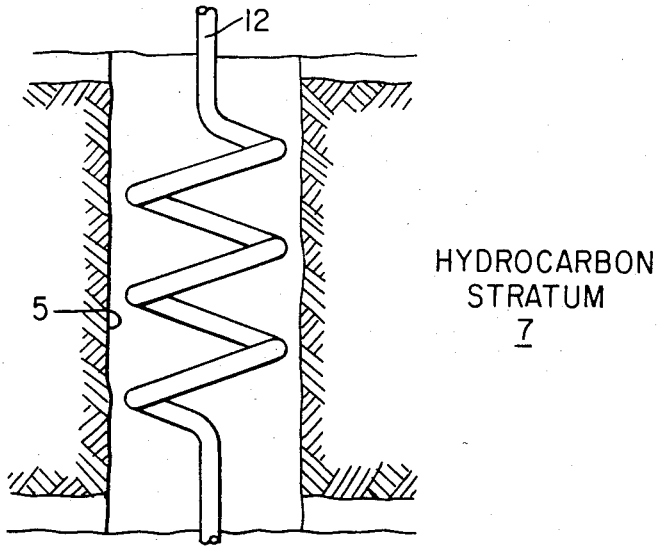
FIGS. 2 and 3 show two embodiments of production tubing formed in accordance with the present invention traversing the oil shale formation.

The present invention allows metal tubing to be used in a producing well where radiant RF energy is being used to heat the earth formation. With reference to FIG. 2, metal tubing 12 is coiled in a helical form so as to cause high self-inductance per unit length of the helical metal tubing 12 so as to reduce the RF induced currents. This reduces the internal heating in the metal tubing. Further, the re-radiated RF energy will be reduced, thus reducing undesirable distortion of the original RF fields near the producing well.

The steel tubing may have a one inch outer diameter with a three-quarter inch inner diameter and the tubing is wound into the form of a right circular cylinder and may, for example, have an overall outside diameter of five inches. The coil of FIG. 2 being formed with four turns per foot of length. The approximate inductance of such an inductor may be determined by a well known formula such as found at page 112 of the ITT "Reference Data For Radio Engineers", 4th Edition, printed by American Book-Stratford Press Inc., New York City, N.Y.

Figure 3:
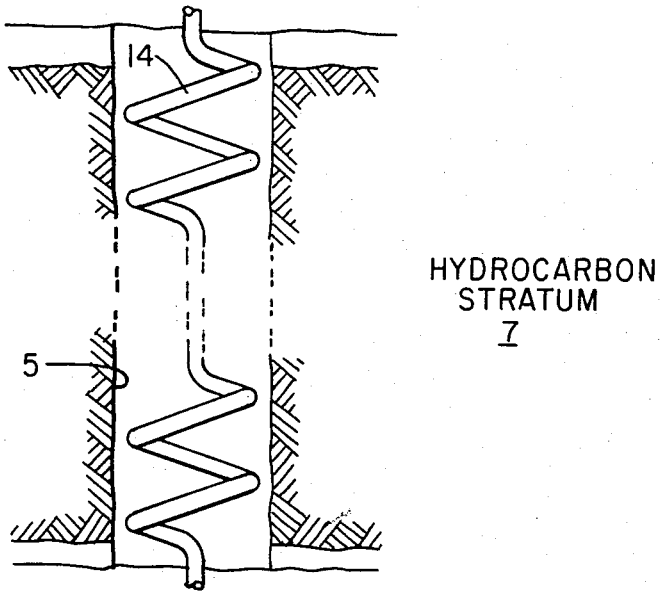

It may be desired that the helical metal tubing be used only in that portion of the well that would be subjected to the high RF fields. The helical tubing could alternately run the full depth or length of the well. The coiled tubing which is an inductor, could be applied as "lumped" inductors inserted between straight (normally short) sections of metal tubing, or for example inserted only near the top of the RF heated region, or near the middle of the heated region. As can be seen in FIG. 3, there are two helical coils separated by a straight length of metal tubing.

There is also the practice in the industry of using thermocouples for measuring temperature in which the thermocouples are removed from the borehole during the RF retorting of the formation and are put into the borehole when the energy is not being transmitted into the earth formation. In this regard the present invention allows the thermocouples to be used during the RF energization of the formation by either having the thermocouples located inside the tubing with the wires being conducted through the tubing, or to be brazed to the outside of the tubing to hold them in place.

It would be advisable for safety reasons to ground the metal tubing 12 or 14 to the well head which itself is grounded.

What is claimed is:

1. A method for obtaining hydrocarbon liquid from a hydrocarbon strata of an earth formation traversed by a borehole, said hydrocarbon strata being subjected to RF electromagnetic energy retorting, comprising the steps of:

(a) forming metal tubing so as to create a tubing coil having a predetermined electrical inductance, (b) connecting straight metal tubing with the metal tubing of step (a) so that the tubing of steps (a) and (b) form a production string, and (c) pumping the hydrocarbon liquid from the borehole through the production string to the surface of the earth formation.

2. A method as described in claim 1 further comprising the step of grounding all metal tubing located in the borehole.

3. A method as described in claim 1 in which the step of forming metal tubing so as to create a tubing coil is done in a manner so that the electrical inductance is related to the frequency of the RF electromagnetic energy.

4. A method as described in claim 3 further comprising the step of grounding all of the metal tubing located in the borehole.

5. A method as described in claim 1 in which the step forming metal tubing so as to create a tubing coil is done prior to locating the metal tubing coil in that portion of the borehole traversing the hydrocarbon strata.

6. A method as described in claim 5 in which the forming step includes forming sections of metal tubing to provide a plurality of coils, each coil having an electrical inductance, and connecting the coils of metal tubing with straight sections of metal tubing.

7. A method as described in claim 6 further comprising the step of grounding all of the metal tubing located in the borehole.

* * * * *